US009533463B2

(12) United States Patent
Gum

(10) Patent No.: US 9,533,463 B2
(45) Date of Patent: Jan. 3, 2017

(54) FILM BAG

(71) Applicant: Mark Gum, East Prairie, MO (US)

(72) Inventor: Mark Gum, East Prairie, MO (US)

(73) Assignee: MONDI JACKSON, INC, Jackson, MO (US)

( * ) Notice: Subject to any disclaimer, the term of this patent is extended or adjusted under 35 U.S.C. 154(b) by 118 days.

(21) Appl. No.: 13/969,575

(22) Filed: Aug. 18, 2013

(65) Prior Publication Data

US 2015/0049965 A1 Feb. 19, 2015

(51) Int. Cl.

| | |
|---|---|
| ***B65D 30/10*** | (2006.01) |
| ***B31B 19/26*** | (2006.01) |
| ***B65D 75/56*** | (2006.01) |
| ***B65D 30/20*** | (2006.01) |
| ***B65D 33/02*** | (2006.01) |
| ***B65D 33/06*** | (2006.01) |

(52) U.S. Cl.

CPC ..... *B31B 19/26* (2013.01); *B65D 31/10* (2013.01); *B65D 33/02* (2013.01); *B65D 33/065* (2013.01); *B65D 75/563* (2013.01); *B31B 2219/146* (2013.01); *B31B 2219/23* (2013.01); *B31B 2219/909* (2013.01); *B31B 2219/9087* (2013.01); *B31B 2219/9096* (2013.01); *B31B 2237/20* (2013.01); *B31B 2237/406* (2013.01); *B31B 2237/50* (2013.01); *B65D 2205/02* (2013.01)

(58) Field of Classification Search

USPC ..... 383/20, 26, 17, 104, 105

See application file for complete search history.

(56) References Cited

U.S. PATENT DOCUMENTS

| | | | | |
|---|---|---|---|---|
| 5,026,173 | A * | 6/1991 | Jensen | B65D 33/06 383/10 |
| 5,048,976 | A | 9/1991 | Jung | |
| 7,775,957 | B2 | 8/2010 | Totani | |
| 2008/0080794 | A1* | 4/2008 | Kruse et al. | 383/14 |
| 2008/0240622 | A1* | 10/2008 | Bell | 383/5 |
| 2009/0202181 | A1* | 8/2009 | Alaux | B31B 19/36 383/7 |
| 2011/0033133 | A1* | 2/2011 | Kujat | 383/20 |
| 2011/0229060 | A1* | 9/2011 | Koesters | 383/21 |
| 2013/0039052 | A1 | 2/2013 | Forteza | |

FOREIGN PATENT DOCUMENTS

| | | | |
|---|---|---|---|
| EP | 1777167 | A | 4/2007 |

* cited by examiner

*Primary Examiner* — Christopher Demeree

(74) *Attorney, Agent, or Firm* — Andrew Wilford

(57) ABSTRACT

A film bag has a pair of longitudinally extending film face panels having longitudinal edges and first and second folded film gussets having longitudinal edges welded at longitudinal seams to respective longitudinal edges of the face panels and formed with two spaced throughgoing cuts forming a handle loop. A separate film inner liner panel lies against an inner face of the first gusset, extends a full transverse width of the first gusset, and is fixed at the longitudinal welds of the first gusset to the front panels so that the liner prevents leakage from the bag through the cuts.

11 Claims, 2 Drawing Sheets

FILM BAG

FIELD OF THE INVENTION

The present invention relates to a film bag. More particularly this invention concerns such a bag with a handle on the side.

BACKGROUND OF THE INVENTION

A typical side-gusset bag made of film comprises two face panels and first and second side gussets between longitudinal edges of the face panels and is attached to the face panels by longitudinal welds. The first side gusset has a handle loop created by cuts in the outer film and a patch of an inner film covers the hole in the first side gusset created by the handle loop.

A film bag comprising the above-described features has been disclosed in EP 1,777,167 and U.S. Pat. No. 5,048,976. A relatively simple manufacture process is possible due to the fact that the handle loop is created by simple cuts in a side gusset. On the other hand, the opening created by the cuts must be sealed on the inside, and for this purpose the prior art provides strips or patches of film on the inside of the film bag. Providing separate film strips is difficult depending on the type of manufacture process. Another disadvantageous aspect is that providing film strips results in stepped levels and transitions being created on the side gusset such that the film strips for creating the seal must also be provided with a circumferential seal. These stepped levels and welds can be disadvantageoous specifically in terms of handling the bag.

There are a variety of manufacture methods for producing side-gusset bags. The entire film bag can, for example, be formed from a single film web by folding. The present invention, however, relates preferably to an embodiment of the bag in which the face panels and the side gussets are made of separate film sections.

U.S. Pat. No. 7,775,957 describes a method for producing film bags in which a bag web is created such that successive bags are adjacent to each other with their longitudinal edges touching. The direction of manufacture here corresponds to a transverse direction of the individual bags. The web is created first that comprises successive, initially attached bag blanks. A first film web is moved in the manufacture direction. A strip is then fed such that the edges of the strip are folded over onto a central section of the strip. The edges are typically of the same width such that a gap still remains between the edges after folding.

Following this, sections of the strip are applied to the first film with equal spacing perpendicular to the manufacture direction (that is longitudinally of the bag) before a second film is fed in the manufacture direction to cover the first film web and the sections of the strips. Longitudinal welds are then made perpendicular to the manufacture direction by which the sections of the strips are welded both to the second film web at the folded-over edges and also to the first film web on its opposite side. From the web thus created, individual film bags are then separated by a transverse cut in the region of the strips so as to create two side gussets of successive film bags from one folded strip.

OBJECTS OF THE INVENTION

It is therefore an object of the present invention to provide an improved film bag and method of making such a bag.

Another object is the provision of such an improved film bag and bag-making method that overcome the above-given disadvantages, in particular that makes a film bag including a handle loop on the side gusset that is simple to produce and ensures a reliable seal in the region of the handle loop.

A further object is to provide a film bag that is easy to handle.

SUMMARY OF THE INVENTION

A film bag has according to the invention a pair of longitudinally extending film face panels having longitudinal edges and first and second folded film gussets having longitudinal edges welded at longitudinal seams to respective longitudinal edges of the face panels and formed with two spaced throughgoing cuts forming a handle loop. According to the invention a separate film inner liner panel lies against an inner face of the first gusset, extends a full transverse width of the first gusset, and is fixed at the longitudinal welds of the first gusset to the front panels so that the liner prevents leakage from the bag through the cuts. The inner liner panel is normally imperforate, but in some applications may have some perforations, for instance for venting overpressure.

Such a bag is made according to the invention by first feeding a first weldable plastic film longitudinally in a travel direction and forming a plurality of tube sections each having an inner layer of weldable plastic film and an outer layer extending over at least half of the inner layer. Only the outer layer of each of the tube sections is formed with a pair of spaced handle-forming cuts. Then the tube sections are applied one after the other at a longitudinal spacing to the first film with the tube sections extending transversely of the first film. A second weldable film is applied to the first film atop the tube sections a second weldable film and advanced longitudinally with the first film. The longitudinally extending edges of the first and second films and ends of the tube sections are then welded together. A pair of longitudinally spaced transverse welds are formed at each of the tube sections a pair of longitudinally spaced transverse welds with the outer layer of each tube section substantially to one longitudinal side of the pair of welds. The first and second films are cut transversely across at the tube sections and between the pair of transverse welds to longitudinally subdivide the films and tube sections into individual film bags.

The face panels and the side gussets are preferably made of separate film sections, with the result that the longitudinal welds are needed to create a bag body. The first side gusset has a handle loop that is created by the cuts in the outer film. The first side gusset is closed inside the handle loop by a separate inner film.

According to the invention, the inner film extends across the entire width of the first side gusset up to the associated longitudinal welds, the inner film being attached to the face panel by the longitudinal welds. As a result, transitions, additional welds, or the like can be avoided in the region of the handle loop. Incorporating the inner film in the longitudinal welds furthermore ensures that a reliable and secure seal is provided.

In a preferred embodiment of the invention, provision is made whereby the inner film also extends across the entire length of the first side gusset, with the result that the entire first side gusset is created in two layer form with the outer film and the inner film. This embodiment also enables stepped levels to be avoided in the longitudinal axis. The first side gusset thus exhibits a uniform structure up to the formation of the handle grip, and can also be easily folded and manipulated.

Unlike the first gusset, the two face panels and the second side gusset are preferably made of only one film sheet so typical multilayer films are used. In order to be able to produce the film bag by welding using the described approach, a multilayer coextruded, or preferably multilayer laminated film is typically used for the face panels, the second side gusset, and the outer film of the first side gusset, which film at a predetermined welding temperature fuses to a weldable outer layer only on one side. The weldable outer layer of the film is on the inside of the bag, thereby enabling the side gussets and front walls to be welded to each other. Since the opposing outer layer of the film is not weldable or is weldable only at an elevated temperature, this outer layer is not negatively affected during manufacture of the bag, thereby also preventing an accidental bonding of the side gussets or visual degradation of the film even when the bag is in the flat-lying state.

Appropriate films include, for example, multilayer laminated films that have a weldable outer layer made of a polyolefin with a low melting point, in particular, polyethylene. Polyethylene terephthalate (PET) or biaxially oriented polypropylene (BO-PP), for example, can be provided as the opposing outer layer that forms the outer surface of the film bag.

The invention offers a variety of different possible designs for the specific design of the handle loop. The handle loop is typically made by two cuts that run along the longitudinal sides of the handle. These cuts run either in a straight line or also in a slight arc along the first side gusset. The cuts accordingly are disposed essentially parallel to the longitudinal welds. A slightly arcuate shape for the cuts can be advantageous in order to narrow the handle at a center section of the handle loop, while the handle loop is then widened toward the ends so as to provide a uniform and reliable distribution of force.

Provision can furthermore be made whereby the cuts to the ends of the handle loop transition into perforation lines. When a high load is placed on the handle loop when in use—if, for example, the film bag is lifted with a sudden jerk—the perforation is able initially to tear open in a controlled fashion. This then prevents any uncontrolled tearing from occurring in the region of the ends of the handle loop in response to a high short-term load. Providing a perforation also offers the advantage that this perforation tears incrementally by alternating between cuts and attached regions. Once the tensile loading diminishes, only the perforation normally continues to tear without the structure of the handle loop experiencing any further degradation.

Independently of the handle loop's design, the film bag can also include additional fittings such as, for example, a reclosable fastener. Appropriate reclosable fastener are, for example, those that include mutually lockable profile tapes. Appropriate reclosable fastener are known in the form of zipper closure means or slider closure means.

As was described above, the second side gusset, the face panels, and the outer film of the first side gusset can be made of a laminated film comprising multiple film layers. The inner film on the first side gusset, on the other hand, should be able to undergo welding on both sides so as to enable it to be welded in the region of the longitudinal welds between outer film and the two face panels. To this end, the inner film can be made of polyolefin, in particular, polyethylene.

It is important to note here that the inner film typically has a reduced barrier effect relative to the outer film, the outer film being pierced by the cuts. In other words, if the shelf life and impermeability of the film bag must meet especially stringent requirements, the inner film too can be advantageously provided with barrier properties. In this case, the inner film can be made of a plurality of different layers by lamination, or preferably coextrusion. However, the inner film should be capable of undergoing thermal welding on both sides in this arrangement as well.

For purposes of increasing the carrying capacity, it is in principle possible to provide an additional reinforcement film between the inner film and the outer film, the reinforcement film being incised along with the outer film so as to create the handle loop. This type of reinforcement film can also extend longitudinally and transversely across the entire side gusset. In general, however, it is sufficient to provide the reinforcement film as an additional section only in the region of the handle loop. In this embodiment, a side gusset is made that in certain sections has two layers (inner film and outer film) and in other sections has three layers (inner film, reinforcement film, and outer film). Nevertheless, even this type of film bag can still be easily manipulated during manufacture and filling since the reinforcement film does not have to be provided with an airtight seal. The seal of the handle loop is also reliably provided by the inner film in this type embodiment that has three layers in certain sections.

The carrying load of the film bag is typically taken up at least to a large extent by the outer film. In order to further enhance the load-bearing capacity, it can nevertheless be advantageous for the inner film and the outer film to be attached by a transverse weld at the ends of the handle loop. This enables the result to be achieved whereby the inner film takes up at least part of the weight of the load, while also providing the ability to prevent contamination from accumulating outside the handle loop between the inner film and the outer film.

A floor for the film bag can be created here both by a separate film sheet or also by a simple weld.

According to the invention, the strip is made in this method from an outer film and an inner film that are not completely attached to each other, the outer film being provided with cuts to create handle loops and the strip being folded in such a way that the inner film in the bag web directly contacts the first film web and the second film web, and is attached to the film webs by longitudinal welds.

The method according to the invention exploits the fact that the front walls and the side gussets are made up of different sections, thereby enabling the handle loops to be easily made on one of the side gussets.

Specifically, the edges of the strips are typically folded over with identical width such that a gap remains between the edges after folding. Subsequently, the successive bag blanks are cut precisely along this center line, thereby producing the side gussets of successive bags from one flattened tubular section of the strip.

Since the purpose is typically to provide the film bag with a handle loop only on one of its side gussets, provision is made with this in mind in a preferred embodiment whereby the inner film on the strip measures half the width of the outer film, the inner film and the outer film being arranged in such a way that the inner film extends from one of the edges of the strip up to a center of the strip. The inner film is then located on the half of the outer film on which the cuts are created.

The invention, in particular, provides an approach whereby the outer film is fed and provided with cuts with uniform spacing in order to create the strip, wherein subsequently the inner film is fed before the edges of the strip are folded over. Prior to the folding process, the inner film and the outer film are preferably attached at individual sites so as to prevent any sliding during the folding.

The outer film here is advantageously folded in such a away that within the strip a non-weldable, or only poorly weldable outer layer of the outer film is folded onto itself, while a weldable outer layer of the outer film is disposed so as to lie on the outside or is covered by the inner film. At least one weak attachment can be generated here on the outer layer of the outer film that is non-weldable or poorly weldable so as to prevent any unintended spreading of the folded edges. Appropriate means include, for example, glue dots. Depending on the material, it is also possible to produce individual bonding sites by means of ultrasound.

If the intention is to provide sections of a reinforcement film between the outer film and the inner film, these sections are first applied to the outer film before the cuts are formed in the outer film and the reinforcement film, and only following this is the inner film applied.

If the intention is to bond by welding between the inner film and the outer film in the region of the ends of the handle loop, this welding is advantageously performed before the edges are folded over.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
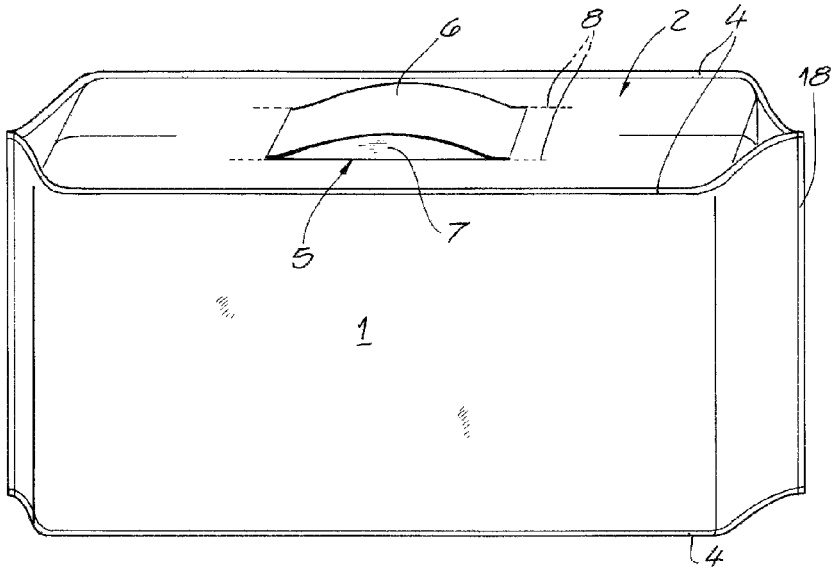
FIG. 1 is a perspective view of a side-gusset bag according to the invention.
Figure 2:
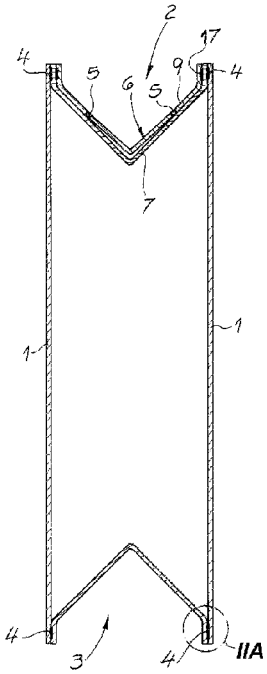
FIG. 2 is a vertical cross-section through the side-gusset bag according to the invention in the region of a handle loop.

As seen in FIG. 1 a film bag comprises two face panels 1, a first side gusset 2, and a second side gusset 3 (FIG. 2 only). The side gussets 2 and 3 are between the two face panels 1 and are attached to the face panels 1 by longitudinal welds 4. The first side gusset 2 has a handle loop 6 formed by straight and parallel longitudinal cuts 5, and the hole formed by the handle loop 6 is covered on the inner side of the first gusset 2 by a separate inner lining film 7. Thus the handle loop 6 is actually an integral raised rectangular piece of the side gusset 2. At each longitudinal end, the panels 1 and gussets 2 and 3 are sealed together at a single transverse weld 18.

FIG. 1 furthermore shows that the cuts 5 are extended at each end as longitudinally extending perforation lines 8 at the ends of the handle loop 6. These perforation lines 8 are intended to ensure there is no uncontrolled transverse tearing when an excessive load is placed on the handle loop 6.

As indicated in the cross-section of FIG. 2, the inner film 7 extends transversely and longitudinally in the region of the handle loop 6 across the entire width and length of the first side gusset 2. The inner film 7 is accordingly attached to both the face panels 1 at the longitudinal and transverse welds 4 and 18. The first side gusset 2 is thus formed by an outer film 9 and the inner lining film 7, the cuts 5 only passing through the outer film 9 so that the inner lining film 7 ensures a tightly sealed closure at the handle loop 6, preventing leakage from the bag. Since the inner lining film 7 on the first side gusset 2 extends across the entire width and the entire length of this side gusset 2 a reliable seal is achieved without transitions or additional welds.

FIG. 2 also shows that both front walls 1 and the outer film 9 of the second side gusset 3 are each made of only one film. A multilayer film is preferably used for the two face panels 1, the outer film 9 of the second side gusset 2 and all of the first side gusset 1 and has an inner weldable layer 10 on the inside of the film bag and an outer non-weldable layer 11 on the opposite side. The non-weldable layer 11 does not fuse, unlike the weldable layer 10, when the longitudinal and transverse welds 4 and 18 are made. The weldable layer can be made, in particular, of a polyolefin such as, for example, polyethylene (PE). A polyester such as polyethylene terephthalate (PET), or a biaxially oriented polypropylene (BO-PP) can be used for the non-weldable layer.

Figure 3:
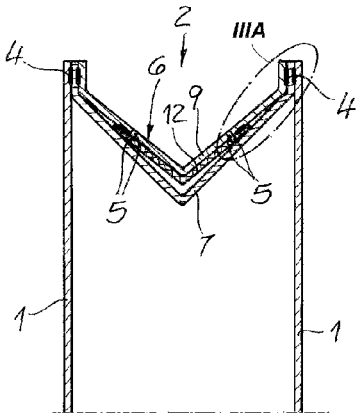
FIG. 3 is a section like FIG. 2 for an alternative embodiment of the film bag.
Figure 2A:
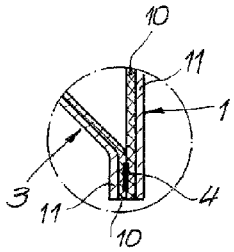
FIG. 2A is a large-scale view of the detail indicated at IIA in FIG. 2.
Figure 3A:
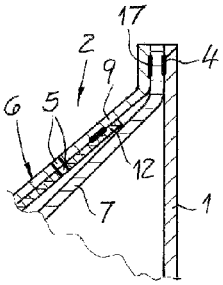
FIG. 3A is a large-scale view of the detail indicated at IIIA in FIG. 3.

FIG. 3 shows a variant of the film bag in which a reinforcement film 12 is provided between the inner lining film 7 and the outer film 9. The reinforcement film 12 is cut through together with the outer film 9 so as to form an inner layer on the loop 6 and increase the load-carrying capacity of the handle loop 6. Sealing accordingly continues to be effected by the inner lining film 7 that in this embodiment also extends across the entire length and width of the first side gusset 2.

This film bag is made by a method wherein a web comprising multiple successive bag blanks is cut transversely to subdivide it longitudinally into the finished film bags. Such a method is disclosed in FIG. 4 of U.S. Pat. No. 7,775,957, which is herewith incorporated by reference.

Figure 4:
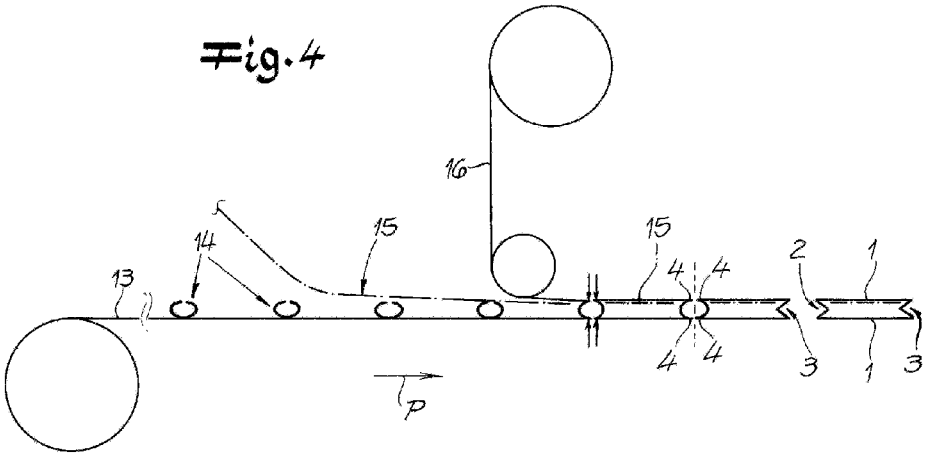
FIG. 4 is a schematic diagram showing the manufacture of the film bag.

Initially, a first film web 13 from which one of the face panels 1 will subsequently be created is fed in a longitudinal feed direction P. A strip formed into a circular-section tube with the lengthwise edges of the strip upward and slightly spaced is fed transversely to and laid on the web 13, then cut off, leaving short tubular sections 14 of the strip lying atop the strip 14. FIG. 4 shows how the cut-off sections 14 of the strip are applied at a uniform longitudinal spacing and extending transversely to the direction P on the first film web 13. If the intent is to provide the film bags with a reclosable fastener 15, it is applied before a second film web 16 is laid on top of the first film web 13 and the strip sections 14.

Subsequently, pairs of the longitudinal welds 4 are made perpendicular to the direction P on the diameter of each tubular section 14 so as to weld the strip sections 14 both to the second film web 16 at the folded-over edges and also to the first film web 13 on the opposite side.

The webs 13 and 16 as well as the tube sections 14 are then cut through transversely of the direction P between each pair of the welds 4 so that individual film bags are separated from the webs 13 and 16 thus welded together sandwiching the strip sections 14. The cut is made at the centers of the strip sections 14, thereby creating the two side gussets 2 and 3 of successive film bags from respective halves of one folded strip section 14.

Figure 5:
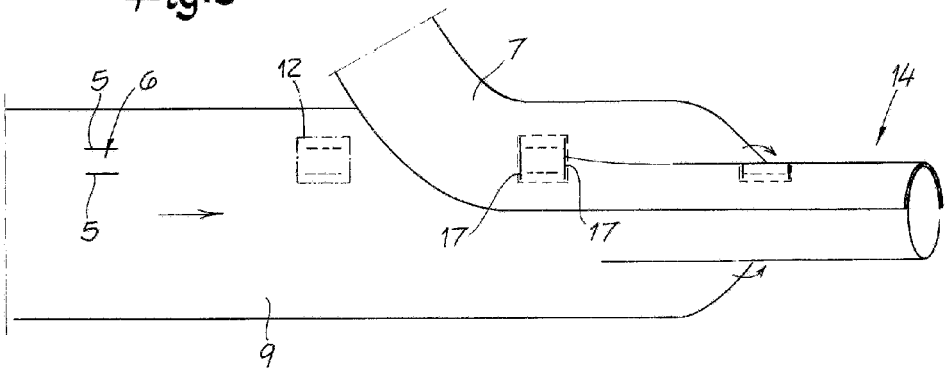
FIG. 5 is a large-scale diagram illustrating some of the steps for creating a strip comprising an outer film and an inner film.

According to the invention, the strip sections 14 are created from the above-described outer film 9 and inner lining film 7. As indicated in FIG. 5, the outer film 9 is fed and provided with the cuts 5 to create the handle loops 6. The inner lining film 7 is half as wide as the outer film 9 laminated to it so that only the first side gusset 2 is reinforced with the inner lining film 7 and the part of the section 14 forming the second side gusset 1.

If the first gusset 2 of the embodiment of FIG. 3 is to be optionally provided with the reinforcement film 12, this film 12 is applied to the outer film 9 before the inner lining film 7 is fed in. In order to increase the carrying capacity of the handle loop 6, the inner lining film 7 and the outer film 9 can be attached to each other by longitudinal welds 17 (FIG. 5). The edges are then folded downward onto the strip section 14.

Figure 6:
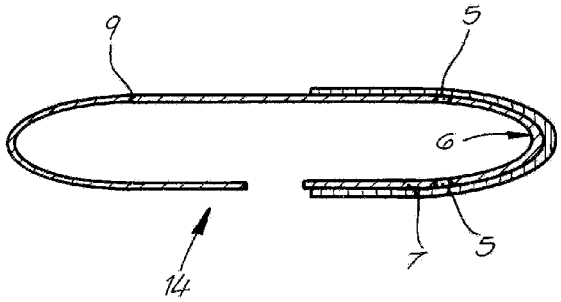
FIG. 6 is a cross-section through the strip shown in FIG. 5.

FIG. 6 shows a cross-section through the strip section 14 thus created without the reinforcement film 12. If such strip sections 14 are used in the FIG. 4 process to make film bags, only one of the two side gussets 2 of the film bags has the handle loop 6.

I claim:

1. A film bag comprising:

a pair of longitudinally extending film face panels having longitudinal edges and transversely extending end edges;

first and second folded film gussets having longitudinal edges and transversely extending end edges;

longitudinal welds forming longitudinal seams between the longitudinal edges of the film gussets and the respective longitudinal edges of the face panels, the first gusset having between the respective longitudinal seams two spaced throughgoing cuts forming a handle loop;

transverse welds forming transverse seams between the transverse end edges of the film gussets and the transverse end edges of the face panels; and a separate film inner liner panel longitudinally coextensive and transversely coextensive with and lying only against an inner face of the first gusset, extending a full transverse width between the longitudinal edges of the first gusset and a full longitudinal length between the transverse end edges of the first gusset, and fixed at the longitudinal and transverse welds of the first gusset to the face panels, whereby the liner prevents leakage from the bag through the cuts.

2. The film bag defined in claim 1, wherein the face panels and the second gusset are each formed by a single-layer plastic film.

3. The film bag defined in claim 1, wherein the first gusset is of the same plastic film as the face panels and second gusset.

4. The film bag defined in claim 1, wherein the cuts and the handle loop extend longitudinally.

5. The film bag defined in claim 4, wherein perforation lines extend longitudinally outward from ends of the cuts.

6. The film bag defined in claim 4, wherein the first gusset panel is formed by a plurality of film layers and the lining panel is formed of a polyolefin.

7. The film bag defined in claim 6, wherein the inner layer is polyethylene.

8. The film bag defined in claim 6, further comprising:

a reinforcing layer between the inner layer and outer layer and connected to the handle loop.

9. The film bag defined in claim 1, further comprising:

a transversely extending reclosable fastener in one of the face panels.

10. The film bag defined in claim 1, wherein the liner is between the first gusset and the face panels at the longitudinal and transverse seams.

11. The film bag defined in claim 1, wherein the film inner liner panel is fixed to the first gusset only at the respective longitudinal and transverse seams.

* * * * *